US006565189B2

(12) United States Patent
Yamada et al.

(10) Patent No.: US 6,565,189 B2
(45) Date of Patent: May 20, 2003

(54) WASTE INK ABSORBER, PRE-EJECTED INK RECEIVING DEVICE AND INK-JET RECORDING APPARATUS

(75) Inventors: Kaneji Yamada, Tokyo (JP); Tetsuya Edamura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,331

(22) Filed: Apr. 17, 2001

(65) Prior Publication Data

US 2001/0038400 A1 Nov. 8, 2001

(30) Foreign Application Priority Data

Apr. 19, 2000 (JP) ..... 2000-118563

(51) Int. Cl.[7] ..... B41J 2/165
(52) U.S. Cl. ..... 347/36; 347/34
(58) Field of Search ..... 347/36, 29, 30, 347/31, 33, 34, 35, 10, 11, 14

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,428,380 A | * | 6/1995 | Ebisawa | 347/12 |
| 5,430,471 A | * | 7/1995 | Nakajima et al. | 347/87 |
| 5,479,196 A | * | 12/1995 | Inada | 347/60 |
| 5,563,639 A | * | 10/1996 | Cameron et al. | 347/34 |
| 6,109,742 A | * | 8/2000 | Higuma et al. | 347/86 |
| 6,145,956 A | * | 11/2000 | Koitabashi et al. | 347/23 |
| 6,168,258 B1 | * | 1/2001 | Lou et al. | 347/33 |
| 6,283,574 B1 | | 9/2001 | Sugimoto et al. | 347/23 |

FOREIGN PATENT DOCUMENTS

| | | | | |
|---|---|---|---|---|
| JP | 54-56847 | | 5/1979 | |
| JP | 357205157 A | * | 12/1982 | 347/22 |
| JP | 59-123670 | | 7/1984 | |
| JP | 59-138461 | | 8/1984 | |
| JP | 60-71260 | | 4/1985 | |

OTHER PUBLICATIONS

Uchikata et al., U.S. Application No. 09/461,355, filed Dec. 15, 1999, pending.
Yamada, U.S. Application No. 09/634,539, filed Aug. 8, 2000 pending.
Edamura, U.S. Application No. 09/639,081, filed Aug. 16, 2000 pending.

* cited by examiner

*Primary Examiner*—Shih-Wen Hsieh
(74) *Attorney, Agent, or Firm*—Fitzpatrick, Cella, Harper & Scinto

(57) ABSTRACT

In a pre-ejected ink receiving device including a waste ink absorber for receiving ink dropped from a pre-ejection as waste ink, since ink mist flows are not controlled properly, the conventional ink-jet recording apparatus has a big problem of contamination, caused by flown up ink mist from a pre-eject port and flown out ink mist from a gap between the pre-eject port and the waste ink absorber, which is accumulated in the recording apparatus by repeated recording operation. A waste ink absorber with rough density to which an ink droplet ejected by the pre-ejection directly collides, solves the above-mentioned problem.

16 Claims, 9 Drawing Sheets

WASTE INK ABSORBER, PRE-EJECTED INK RECEIVING DEVICE AND INK-JET RECORDING APPARATUS

BACKGROUND OF THE INVENTION

1. Field of the Invention

The present invention relates to a waste ink absorber which is equipped in an ink-jet recording apparatus having ink-jet heads to eject ink for recording, for controlling spreading ink flow due to blown up ink mist from ink preeject ports and spreading ink mist from a gap between ink pre-eject ports and the waste ink absorber, and also relates to the ink-jet recording apparatus equipped with a pre-ejected ink receiving device.

2. Brief Description of the Related Art

Various kinds of recording methods, for example, wire-dot methods, thermal methods, thermal transfer methods or the ink-jet method have been proposed as mountable recording heads for recording apparatuses to record on paper, cloth, plastic sheet and OHP sheet etc. (Hereinafter simply referred as "recording paper").

Among these methods, the ink-jet methods, one of the non-impact methods with low noise to deposit ink directly on the recording paper by ejecting ink, are on the whole classified into continuous methods (including an electric charge controlling method and a spraying method) and on demand methods (including a piezo-electric method, a Spake method and a bubble-jet method).

In the continuous methods, ink is continuously ejected, where electric charges are charged to only required liquid droplets. Some of the charged droplets are deposited on the recording paper and remaining droplets are wasted. On the other hand, in the on-demand methods, since ink is ejected upon only requests for printing, ink is not wasted. However, in these method ink is ejected intermittently, responding frequencies in these methods are lower than responding frequencies in the continuous methods. A higher printing rate is realized by increasing ejecting nozzle number. Due to reasons mentioned above, most of the available recording apparatuses are employed on-demand methods. Since recording apparatuses equipped with ink-jet recording heads attain denser and higher rate recordings, they are practically used as output means for information processing systems such as printers as output terminals for copying machines, facsimiles, electronic type writers, word processors and work stations etc., or handy or portable printers for personal computers, host computers, optical disk devices and video recording devices etc.. Ink-jet recording apparatuses are modified so as to meet requirements in various applications described above.

Generally, a carriage for mounting a recording means (recording head) and an ink tank, a feeding means for feeding the recording paper and a control means for controlling these means are arranged in the ink-jet recording apparatus.

The recording head for ejecting ink droplets from a plurality of eject ports are serially scanned in a perpendicular direction (a main scanning direction) to a paper feeding direction (a sub scanning direction) during printing operations, while the recording paper is intermittently fed by a width corresponding to a gap between two neighboring printing lines during non-printing periods. This method where ink is ejected onto the recording paper in response to recording signals may be operated at lower cost and widely used as a calm recording method. When the recording head equipped with a plurality of nozzles for ejecting ink, arranged in series along the sub-scanning direction is used, printing lines corresponding to the nozzle number are recorded simultaneously by scanning the recording head over the recording paper one time. Which may realize printing operations with much higher rate.

However, in the above-mentioned conventional ink-jet recording apparatus, there is a significant problem that ink contamination, due to blown up ink mist from the ink pre-eject port and spreading ink mist from a gap formed between the ink pre-eject port and the waste ink absorber, is deposited the more in the recording apparatus as the more printing operations are executed, since a pre-ejected ink receiving device including the waste ink absorber does not control flowing ink mist.

SUMMARY OF THE INVENTION

The present invention is carried out in view of the above-mentioned problem, to provide a waste ink absorber, a pre-ejected ink receiving device and a platen for controlling the ink mist flow and also to provide an ink-jet recording apparatus equipped with these members.

In order to attain the above-mentioned objective, the waste ink absorber according to the present invention to which ink droplets from the ink pre-eject port directly coillide, is formed out of a material with rough density.

The waste ink absorber according to the present invention is formed out of a foamed material having foam cells less than 300/inch.

The pre-ejected ink receiving device according to the present invention is characterized that the waste ink absorber formed out of the material with rough density and an incident angle of the ink droplet against the above-mentioned waste ink absorber is acute.

Further the ink-jet recording apparatus according to the present invention where the above-mentioned pre-ejected ink receiving device is employed is characterized that an eject velocity of ink during pre-ejection is set slower than an eject velocity of ink during printing operation.

In addition the ink-jet recording apparatus according to the present invention where the above-mentioned pre-ejected ink receiving device is employed is characterized that a driving frequency of the pre-ejection is set lower than a driving frequency of printing operation.

And the ink-jet recording apparatus according to the present invention where the above-mentioned pre-ejected ink receiving device is characterized that ejected ink volume during the pre-ejection is set larger than ejected ink volume during printing operation.

The waste ink absorber, the pre-ejected ink receiving device and the ink-jet recording apparatus according to the present invention arranged in the above-mentioned way comprising: the waste ink absorber to which the pre-ejected ink droplet collides, is formed out of the material with rough density; the colliding incident of the ink droplet against the waste ink absorber is set acute; a space is arranged around a position where ink mist generated by the collision is flown up for floating or absorbing the ink mist; an exhausting port for discharging the ink mist and discharging path for leading the ink mist to the exhausting port are formed like a maze structure; turning around portions such as cul-de-sacs are formed in the discharging path; waste ink absorbers which receive the pre-ejected ink or the pre-ejected ink receiving device is arranged in a V shape; a shielding member of the pre-eject port arranged on a platen is protruded inside a compartment formed by the arrangement of the waste ink absorber or the pre-ejected ink receiving device where the shielding member is formed in a tapered shape; a thin plate is arranged around the pre-eject port at a side where the carriage moves after the pre-ejection and at a higher position than the pre-eject port for generating turbulent flows around the pre-eject port by the movement of the carriage; air vents formed around a position where the carriage reverses its moving direction wherein; an ink ejecting velocity of the pre-ejection is set lower than an ink ejecting velocity of the printing operation, an ink ejecting volume during the pre-ejection is set larger than an ink ejecting volume during the printing operation for reducing the flying velocity of the ink mist generated during the pre-ejection at the exhausting port having turn around portions.

DETAILED DESCRIPTION OF THE PREFERRED EMBODIMENTS

Hereinafter the waste ink absorber, the pre-ejected ink receiving device and the ink-jet recording apparatus according to the present invention are explained in detail by referring drawings.

Embodiment 1

Figure 13:
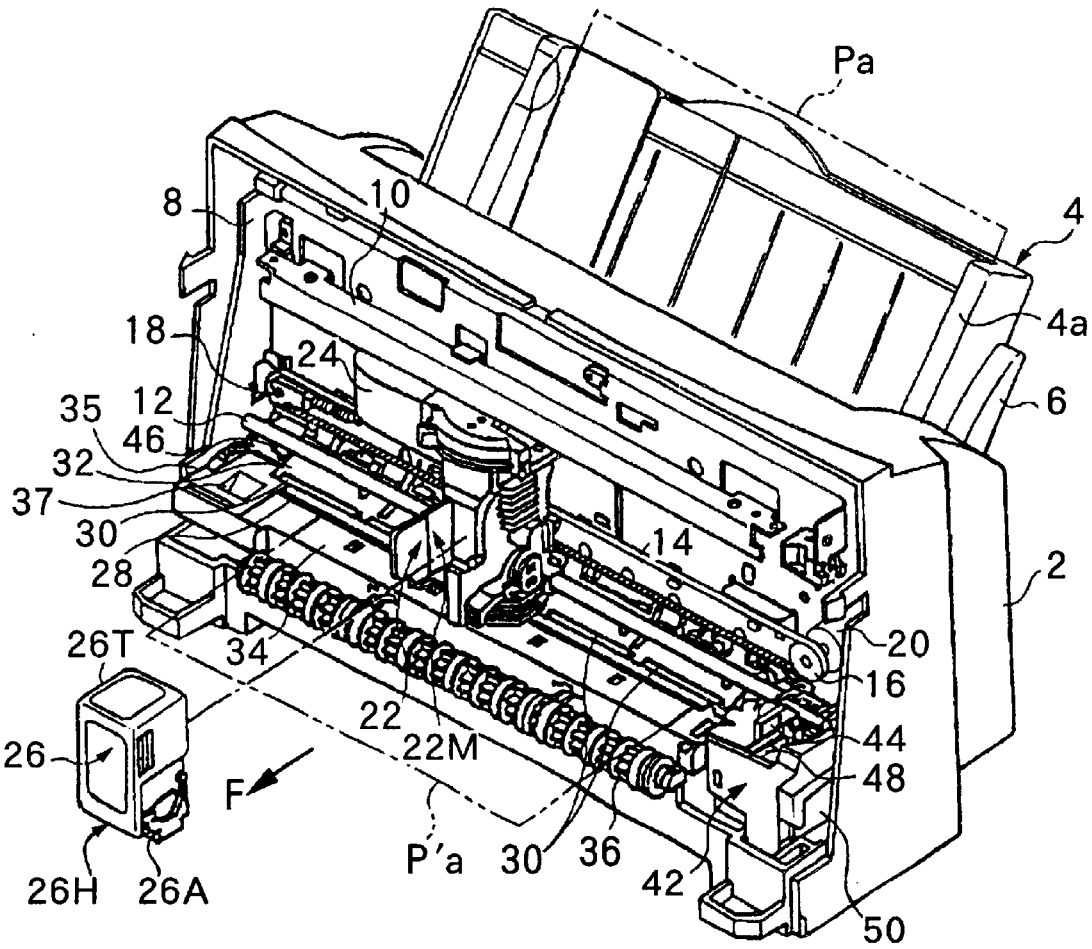
FIG. 13 is a perspective view illustrating an example of the structure of the ink-jet recording apparatus where an ink recovery treatment is applied according to the present invention.
Figure 14:
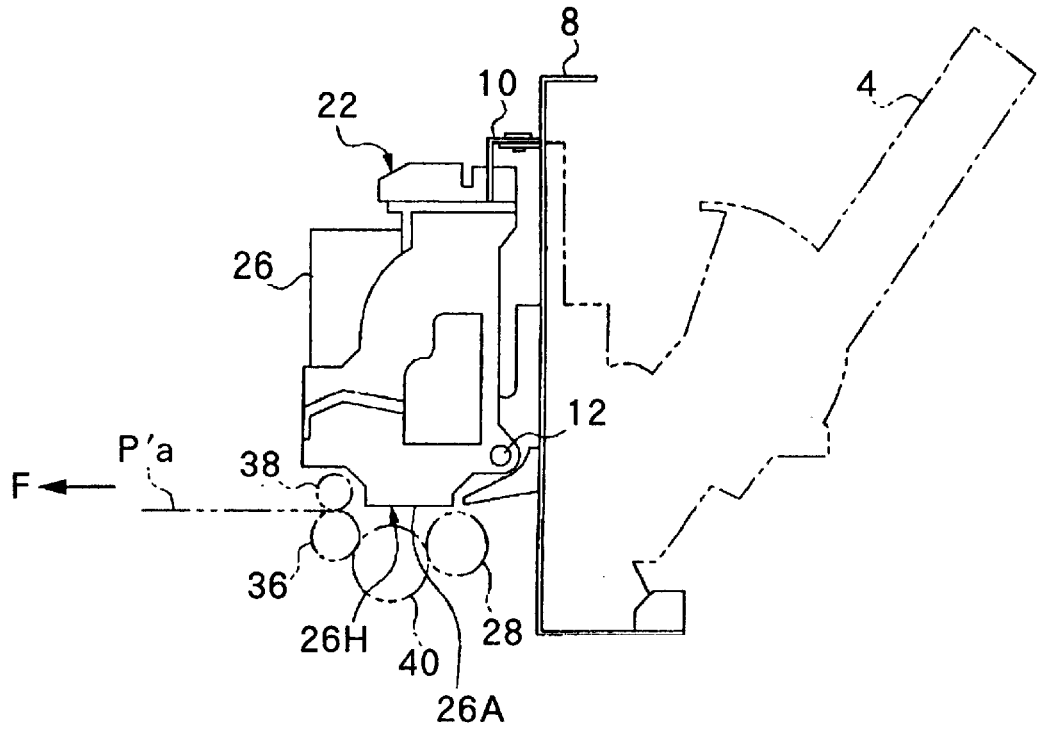
FIG. 14 is a partial sectional view of the recording apparatus shown in FIG. 13.

FIG. 13 and FIG. 14 show an ink-jet recording apparatus where an example of the pre-ejected ink receiving device equipped with the waste ink absorber according to the present invention.

As shown in FIG. 13 the ink-jet apparatus comprises; a chassis 2 behind which papers Pa as recording media are accommodated and mounted, a paper supply member 4 for sending papers sheet by sheet to a transferring member which will be explained in detail, a combination of a transfer roller 28 and a pinch roller 30 to hold the sheet of paper for transferring papers Pa on a platen 34 which will be explained in detail, an ink cartridge 26 having a recording head 26H which records on the recording papers Pa transferred to the platen 34 by ejecting ink, a carriage 22 on which the ink cartridge is mounted demoutably so as to scan in a perpendicular direction to the transferring direction of the recording papers Pa, paper discharging rollers 36 and spurring rollers 38 which roll cooperatively for discharging a recorded paper P'a by the recording head 26H in a direction F, namely, forward from the chassis 2, a pre-ejected ink receiving device where a pre-ejected ink receiving member 35 on which an ink pre-eject port 37 is formed at a position where ink is pre-ejected as the ink recovery treatment.

As shown in these figures, the paper supplying member 4 is formed in an incline state at the back of the chassis 1. One side end of the recording paper Pa is regulated by a side guide member 4*a* supported by the paper supplying member 4 movably along almost perpendicularly to the paper supplying direction. At one side end of the paper supplying member 4, a changing lever 6 to change an auto-supply where the recording paper Pa mounted on a inclined surface of the paper supplying member 4 is fed sheet by sheet automatically into a manual supply where the recording paper is fed sheet by sheet manually via an unshown feeding port, and vice versa. As shown in FIG. 13 a lower end of the paper supplying member 4 is fixed to a supporting member 8 formed on the chassis 2.

In front of the supporting member 8, a feeding roller 28 is arranged and fixed to revolving axes movably supported by both side ends of the supporting member 8. The central axis of the feeding roller 28 extends in an almost perpendicular direction to the feeding direction of the recording paper Pa. A driving axis of a feeding motor 46 to rotate the feeding roller 28 is connected to one of the revolving axes.

A plurality of pinch rollers fixed to a revolving axis arranged parallel to the feeding roller 28, are fitted to the periphery of the feeding roller 28. Both end of the revolving axis to which a plurality of pinch rollers are fixed are rotatably supported respectively by side ends of the support member 8. Above the pinch rollers 30 a pinch roller guide 32 for guiding the recording paper Pa between the peripheries of the feeding roller 28 and a plurality of the pinch rollers 30, is arranged. Due to this arrangement the recording paper Pa is fed forward immediately when the feeding motor 46 is in an operating state. At a downstream side of the feeding roller 28, the platen 34 for supporting the recording paper Pa from the bottom is arranged so as to keep the recording paper Pa flat. At a down stream side of the platen 34 the delivery roller 36 and the spur 38 for cooperatively delivering the recorded paper P'a are arranged. Via an idle roller 40 the delivery roller 36 is revolved by the counter-clockwise revolution of the feeding roller 28. Consequently the recorded paper P'a is delivered by the delivery roller 36 and the spur 38.

In front of the supporting member 8, a guide rail 10 and a guide shaft 12 are arranged respectively at the upper side and lower side so as to face each other. The guide rail 10 is formed of, for example, a thin steel sheet with an L-shaped cross section and both ends are supported by the supporting member 8. Also the guide shaft 12 is fixed to the supporting member 8 parallel to the guide rail 10. A connecting portion of the carriage 22 located upper area is connected to the guide rail 10, while the guide shaft 12 is inserted into a through hole formed on the lower area of the carriage 22 and is supported so as to relatively slide each other. The carriage 22 is also linked to a timing belt 14. The timing belt 14 is turned around pulleys 16 and 18 which are arranged rotatably on the supporting member 8 facing each other and extended between them. The pulley 16 is linked to a driving axis of the carriage driving motor 20. The pulley 18 is supported by a revolving axis rotatably supported to the supporting member 8, so that the carriage 22 is moved rightward/leftward reciprocatingly along the guide rail 10 and the guide shaft 12 via the timing belt driven by the carriage driving motor 20.

One end of a flexible cable 24 is electrically connected to a connecting port of a data inputting circuit board formed on the carriage 22. The carriage 22 has a. mounting portion 22M, where the ink cartridge 26 equipped with the connecting port to be electrically connected to the data inputting circuit board is mounted.

The ink cartridge 26 comprises an ink tank portion 26T in which desired-color inks are stored and the recording head 26H to which inks are supplied from the ink tank portion 26T. As shown in FIG. 14, the recording head 26H is arranged at lower portion of the ink cartridge 26 so that an eject port forming surface 26A faces against the recording surface of the feeding recording paper Pa.

The recording head 26H, for example, has the eject port forming surface 26A where a plurality of eject ports are formed in a row along the paper delivery line F of the recording paper Pa. Each eject port formed on the eject port forming surface 26A is connected to each ink path formed in the recording head 26H. In each ink path an electro-thermal conversion element (not shown in the figure) is arranged as a heater for heating ink to eject ink selectively from each eject port. Each ink path is linked to a common compartment to which ink is supplied from the ink tank portion 26T. Each heater is controlled based on a drive controlling pulse signal group CP from a recording head controlling unit 70 (See FIG. 16. Which will be explained later).

The carriage 22 accompanying the recording head 26H is moved reciprocatingly between a determined distance by controlling the carriage driving motor 20 during recording movement of the recording head 26H. A home position where the carriage 22 stands by during non-recording or during the ink recovery treatment (which will be explained later) is arranged at a pre-determined position from one end of the fed recording paper Pa. As shown in FIG. 13 an ink recovery treatment unit 42 for the ink recovery treatment against the recording head 26H is arranged at the home position. The ink recovery treatment unit 42 comprises; mainly a blade 44 for wiping off ink and the like stuck to the eject port forming surface 26A of the recording head 26H when the recording head 26H moves toward the home position or the recording area, a cap member 48 for contacting selectively and closely to the eject port forming surface 26A of the recording head 26H standing by at the home position and a vacuum pump 50 for sucking via a connecting opening of the cap 48.

The blade 44 is formed out of, for example, a rubber having flexible property so as to wipe off ink stuck to the eject port forming surface 26A of the recording head 26H by the upper portion of the blade. The lower portion of the blade 44 is fixed to one side of a case of the ink recovery treatment unit 42 facing against a feeding path. Accumulated thickened ink on the blade 44 or wiped ink by the blade 44 is put into ink eject ports during wiping operations, is removed from the eject ports by an ejection recovery treatment (hereinafter referred as "pre-ejection") after the recording head is transferred to an ink pre-eject position where a pre-eject port 37 (which is explained later) is formed so as to avoid the recorded quality from deteriorating due to inserted ink into the ink eject-ports.

The cap 48 is arranged on the ink recovery treatment unit 42 in a direction farther away from than the blade 44 apart from the feeding path. The cap 48 is held a holder linked to a sliding device formed in a lifting device (which is not shown in the figure). The lifting device has a well known arrangement comprises; the holder for holding the cap 48 and the sliding device for lifting the holder toward eject port forming surface 26A of the recording head 26H in accordance with movements of the carriage 22.

A portion of the cap 48, which is closely contacted to the eject port forming surface 26A of the recording head 26H, is connected to one end of a sucking tube via a connecting hole (which is not shown in the figure). The other end of the sucking tube is connected to the vacuum pump 50. The vacuum pump 50 is controlled by a controlling unit 64 (see FIG. 16). The controlling unit 64 instructs the recording head 26H for the ink recovery treatment and supplies the ink recovery treatment unit 42 a record initiating instruction signal Scp, an ink recovery treatment initiating instruction signal Scr and a recording operation terminating instruction signal Ss supplied from a recording/recovering instruction unit 60. (See also FIG. 16.)

Data from a data inputting unit 62 is also supplied to the controlling unit 64. The data inputting unit 62 transmits various data when the ink cartridge is exchanged or recording image data is changed. The sliding device lifts the holder toward the eject port forming surface 26A of the recording head by connecting the lower portion of the moving carriage 22 and lowers the holder by a spring means when the carriage 22 moves apart from the home position and is disconnected to the sliding device.

Figure 15:
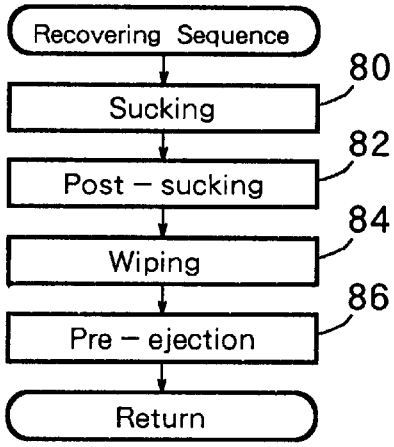
FIG. 15 is a block diagram showing a series of operational example of ink recovery treatment.

In some cases the recording head 26H brings poor print quality due to clogged nozzles etc., but the problem is solved by a recovering sequence depicted in FIG. 15. At a pre-ejection 86 in the recovering sequence the recording head 26H is transferred to a pre-ejecting position (which will be explained later) and ink is ejected a pre-determined frequency (for example 200 ejection per nozzle), namely pre-ejection 86 is not for recording but for removing clogging caused by paper powder, thickened ink etc.. At the pre-eject position where ejected ink directly drops, the waste ink absorber is placed. The pre-eject position is arranged outside of the recording area. For example the pre-eject port 37 is arranged at a position of the carriage 22 where feeding the recording paper Pa by the platen 34 is not influenced and below the pre-eject port 37 a pre-ejected ink receiving member 35 for receiving pre-ejected ink droplet d is arranged.

Figure 1:
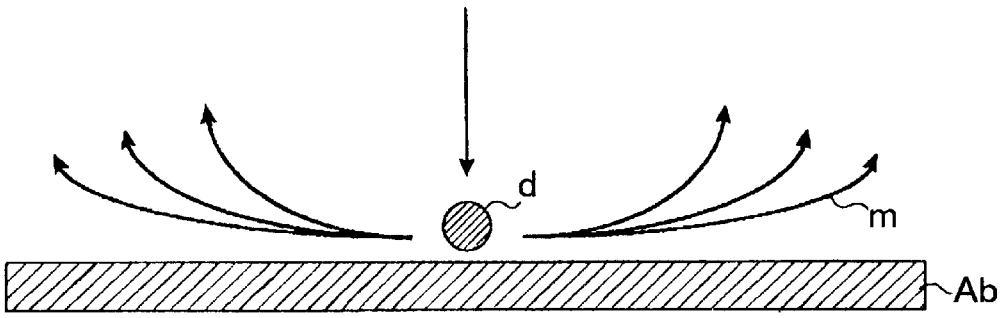
FIG. 1 is illustrating an instant when the ink droplet collides against the waste ink absorber according to the present invention.

According to experiments by the inventors, the ink droplet d ejected from the recording head 26H flies at ca.15 meters/sec. and collides to the waste ink absorber Ab. In these experiments it is confirmed that ink mist generated by the collision flows differently in accordance with an incident angle of the ink droplet d to the waste ink absorber Ab. For example, when the ink droplet d collides perpendicularly to the waste ink absorber Ab (ink is ejected downward in the gravity direction), the ink droplet d spreads in the form of ink mist along a surface of the waste ink absorber Ab as shown in FIG. 1. It is also confirmed by these experiments that a mist spreading area changes in accordance with the colliding incident angle of the ink droplet d to the waste ink absorber Ab. In these experiments spreading behaviors of the mist m are also observed by changing waste ink absorbers with different surface densities and incident angles independently. And the following results are proved; the less dense the surface of the waste ink absorber Ab is, the less quantity of the mist is blown up and when the incident angle is set more acute, the quantity of the mist is decreased.

Figure 2:
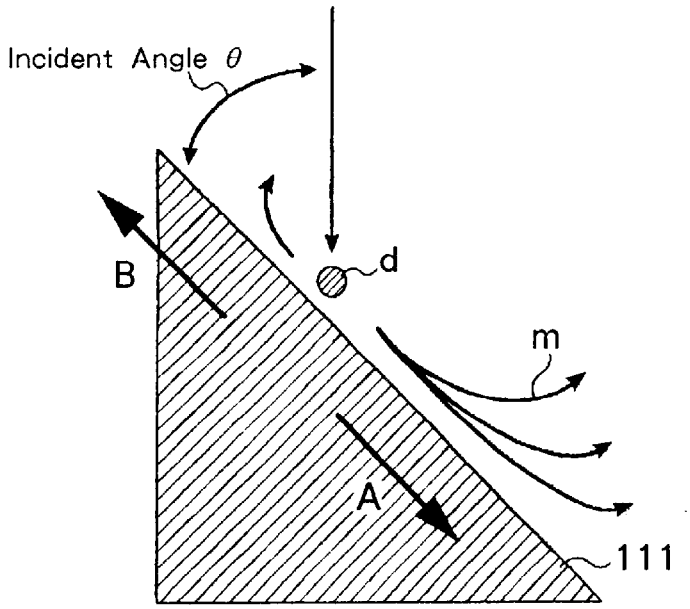
FIG. 2 is illustrating an instant when the ink droplet collides against the waste ink absorber with the acute incident angle according to the present invention.

An example of the results in these experiments is shown in FIG. 2 where the incident angle θ of the ink droplet d to the waste ink absorber 111 is set at 45 degrees (ink is ejected downward in the gravity direction). The collided ink droplet d is transformed into mist m and is blown up in both directions A and B. However, most portion of the mist m is observed flowing and spreading in the A direction while only small portion of the mist m flows upward in the B direction. The reason why the quantity of the blown up mist in FIG. 2 is less than in FIG. 1 is might be that the collision impact of the ink droplet against the waste ink absorber is more dispersed in the case shown in FIG. 2. Based on the above-described observed phenomena the waste ink absorber 111 shown in FIG. 3 is proposed so as to control the blowing up ink mist m, namely to regulate air stream generating positions.

Figure 3:
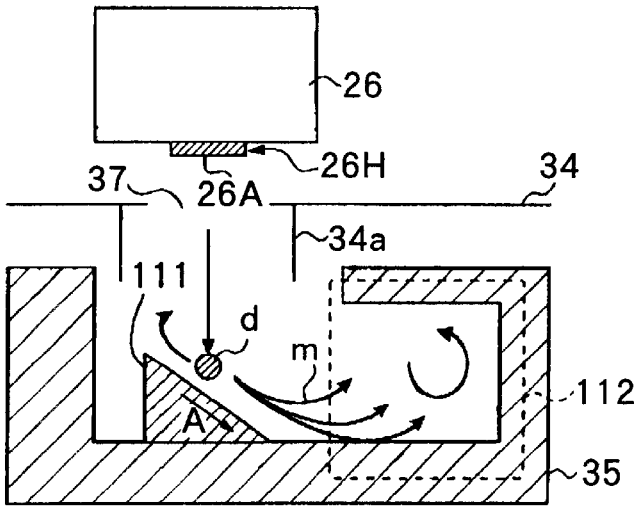
FIG. 3 is a schematic view illustrating a first example of the pre-ejected ink receiving device having the waste ink absorber according to the present invention.

The ink absorbing device shown in FIG. 3 is arranged as follows: the waste ink absorber 111 having an incident angle for the ejected ink droplet d so as to blow up the mist m in the above-mentioned direction A for suppressing the mist flowing toward a pre-eject opening 37 formed on the platen 34, in other words suppressing upward flow of the mist; and a compartment, for example, an air stream buffer compartment 112 for generating turbulent flows so as to reduce flying velocity of the mist m in the direction A. Thus the mist blown up through the pre-eject opening 37 is suppressed and an absorbing rate of the mist m by the waste ink absorber 111 is enhanced.

As shown in the figure the waste ink receiving device is consisted of the platen 34 equipped with the pre-eject opening 37 and the pre-ejected ink receiving member 35 where the waste ink absorber 111 is arranged and the air stream buffer compartment 112 is formed at the side of the waste ink absorber 111. The ink droplet d collided to the waste ink absorber 111 is flown in the direction A in the form of the mist m and flown into the air stream buffer compartment 112 as turbulent flows so that the flying velocity of the mist m is remarkably reduced, as a result, it is absorbed well by the waste ink absorber 111. It is preferable to arrange a shielding member 34*a* under the pre-eject opening 37 of the platen 34. In the present invention the waste ink absorber with rough density is defined as an absorber formed out of foam material having foam cells less than 300/inch Particularly an absorber formed out of foam material having foam cells more than 20/inch is preferable. More specifically absorber formed out of foam material having foam cells more 20/inch and less than 100/inch is preferable. Foamed melamine resins are suitable as the materials for the waste ink absorber. The incident angle of the ink droplet against the waste ink absorber should set between 20 to 50 degrees, more preferably between 30 to 40 degrees.

Embodiment 2

Figure 4:
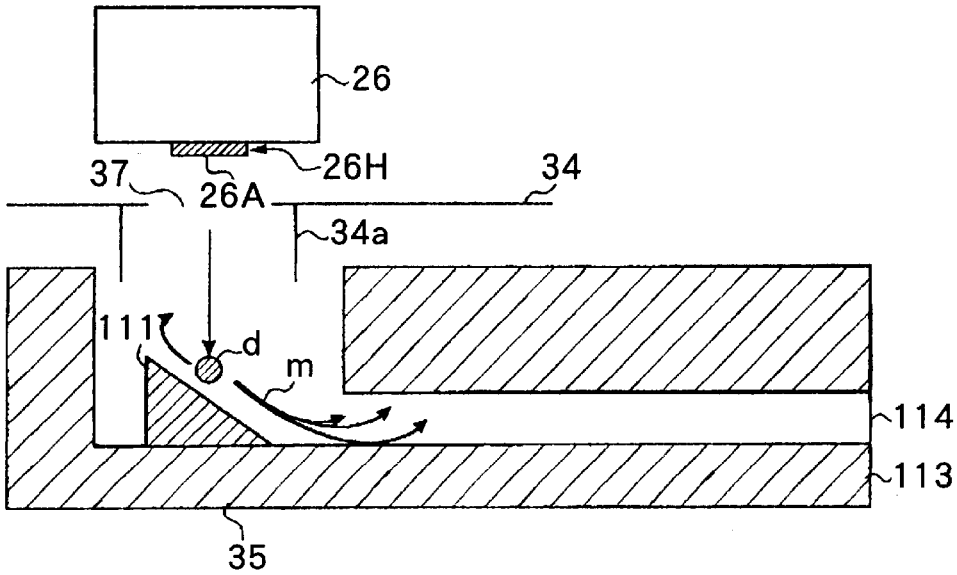
FIG. 4 is a schematic view illustrating second example of the pre-ejected ink receiving device having the waste ink absorber according to the present invention.

In an ink-jet recording apparatus comprising almost in the same way as the embodiment 1, the waste ink absorber 111 having an acute incident angle against pre-ejected ink droplet d is arranged in the pre-ejected ink receiving member 35 so as to flow the ink mist positively in the direction A shown in FIG. 2. The ink mist flowing along the surface of the waste ink absorber 111 is led into a long discharging channel 113 with a small diameter arranged on the pre-ejected ink receiving member 35 for reducing the flying velocity of the mist m and so as to discharge the mist m from an exhaust opening 114 as shown in FIG. 4, thus the flow of the mist m is controlled well.

As shown in the figure the pre-ejected ink receiving device in this embodiment comprises the platen 34 equipped with the pre-eject opening 37 and the pre-ejected ink receiving member 35 where the waste ink absorber 111 is arranged and the long discharging channel 113 with the small diameter is formed in the side direction of the waste ink absorber 111 which receives the ink droplet d. When the ink droplet d collides to the waste ink absorber 111 the mist m is generated and most of it flows in the direction A into the discharging channel 113 where the flying velocity of the mist m is remarkably reduced, and is discharged from an exhaust opening 114.

Since the pre-ejected ink receiving member 35 in which the discharging channel is arranged is formed out of the same material as the waste ink absorber 111, the mist m which flows in the discharging channel 113 is properly absorbed there.

Figure 5:
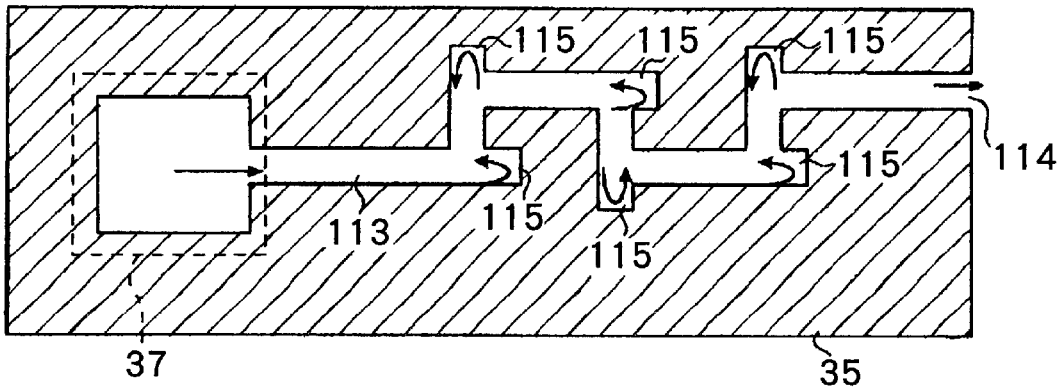
FIG. 5 is a cross sectional plan view of the example shown in FIG. 4.

FIG. 5 shows the plan view of a modified example of the present embodiment. In the pre-ejected ink receiving member 35 the discharging channel 113, as a flow path of the ink mist, is formed like a maze having a plurality of turn around portions 115 along the flow path so as to generate turbulent flows at the turn around portions 115 for reducing the flying velocity of the mist m and for absorbing the mist there. Thus the ink mist m is removed while it flows through the discharging channel 113 and is exhausted from the exhausting opening 114 as almost ordinary air.

In this embodiment the discharging channel 113 is arranged laterally in FIG. 5, but the discharging channel 113 may also be arranged vertically or three dimensionally. The structure as the discharging channel 113, namely a ventilating structure is arranged at a portion where ink mist m is reserved and the ink mist m is pushed out to the exhausting port 114 via the maze like discharging channel 113 by an air flow from the pre-eject port 37 to the waste ink absorber 111 generated by the pre-ejected flying ink droplet d.

Thus the flow of the ink mist m is controlled by the arrangement described above. Further the structure having the turn around portions 115 like cul-de-sacs formed along the discharging channel 113 causes turbulent flows so that the flying velocity of the ink mist is remarkably reduced, thus the ink mist is properly absorbed by the pre-ejected ink receiving member 35 formed out of the waste ink absorbing material. Since the air after the almost all the ink mist m is removed, is exhausted from the exhausting opening 114 via the discharging channel 113, blown out ink mist from gaps among parts of the recording apparatus is suppressed, which realizes a recording apparatus with remarkably reduced contamination from the ink mist.

Embodiment 3

Figure 6:
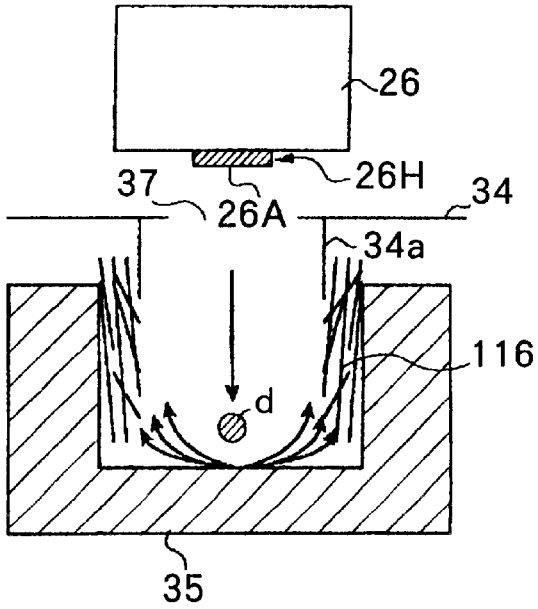
FIG. 6 is a schematic view illustrating a third example of the pre-ejected ink receiving device having the waste ink absorber according to the present invention.

In the present embodiment, as shown in FIG. 6 the ink mist m is kept from flowing up, dispersed and well controlled by employing a member 116 formed out of a water repellant fibrous or network structured material arranged portions where the pre-ejected ink droplet d does not contact directly. The blown up mist m collides to the above-mentioned member 116 and is dispersed so as to generate the turbulent flows by the above mentioned fibrous or net structured member 116, consequently the flying velocity of the ink mist m is reduced gradually and finally it is absorbed by the pre-ejected ink receiving member 35 formed out of the waste ink absorbing material having foam cells with 300/inch. The shielding member 34*a* is arranged under the pre-eject opening 37 of the platen 34 so as to prevent the ink mist m flowing into below the platen 34.

Embodiment 4

Figure 7:
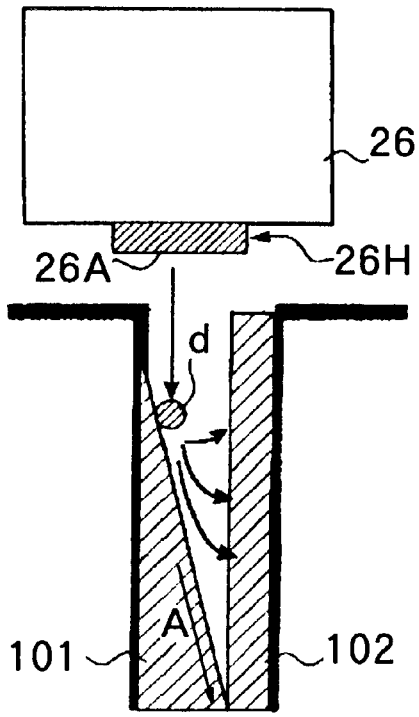
FIG. 7 is a schematic view illustrating a fourth example of the pre-ejected ink receiving device having the waste ink absorber according to the present invention.

In the present embodiment a structure of the waste ink absorber shown in FIG. 7 is particularly effective when the space for the arrangement is limited and quantity of ejected ink droplets to the waste ink absorber is small. A waste ink absorber 101 is arranged having a more acute incident angle of the ink droplet d ejected from the recording head 26H so that almost all ink mist m flows in the direction A. In addition other waste ink absorber 102 is arranged almost upright so as to form a wedged like space formed between two waste ink absorbers 101 and 102. The more acute the incident angle against the waste ink absorber 101 is set, the more positively the velocity of the ink droplet is reduced. However, since the reducing rate of the velocity is not so much reduced as the incident angle is reduced, still there are possibilities that secondary mist might be generated in the waste ink absorber 101. According to experiments by the inventors, when the incident angle of the ink droplet against the waste ink absorber 101 is set 20 to 50 degrees more preferably 30 to 45 degrees, the ink droplet d with a velocity of 15 meters/sec. is properly absorbed without causing any blown up mist. Further since the inventors confirmed that when a material with rough density is used for the waste ink absorbers 101 and 102, quantity of the generating ink mist during the collision is reduced, it is possible to arrange the waste ink absorbers easily at a narrow space and to realize saving the space for the arrangement if waste ink absorbers 101 and 102 described here are used.

Embodiment 5

Figure 8:
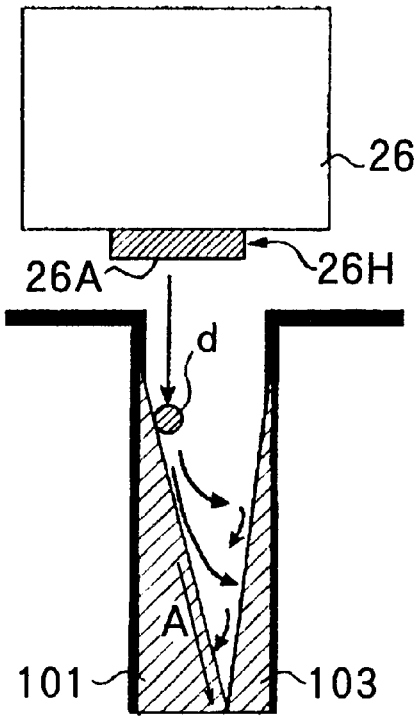
FIG. 8 is a schematic view illustrating a fifth example of the pre-ejected ink receiving device having the waste ink absorber according to the present invention.
Figure 9:
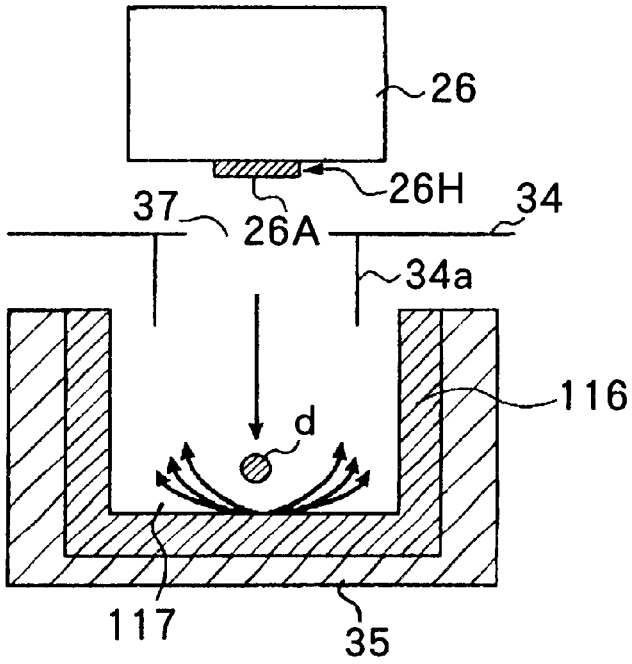
FIG. 9 is a schematic view illustrating a sixth example of the pre-ejected ink receiving device having the waste ink absorber according to the present invention.
Figure 10:
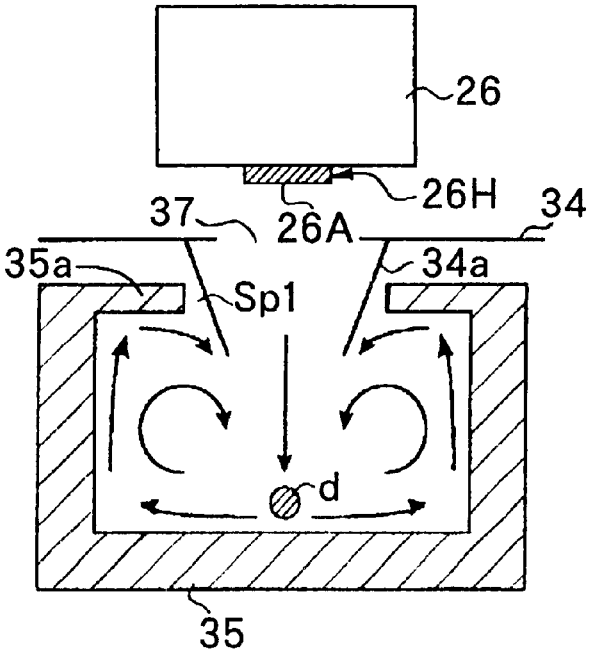
FIG. 10 is a schematic view illustrating an examples of structures of the pre-ejected ink receiving device formed of the waste ink absorber and of the platen according to the present invention.

As shown in FIG. 8 through the observations in the above-mentioned experiments it is confirmed that the stream of the ink mist flows downward. In the present embodiment taking these observations into consideration, the waste ink absorber 101 is arranged so that the incident angle of the ink droplet d ejected from the recording head 26H against the waste ink absorber 101 is set acute for flowing most of the ink mist m in the direction A and the other waste ink absorber 103 is arranged against the waste ink absorber 101 with a little bit inclined state from the vertical position so as to form a V-shaped space i.e. wedgelike space formed between the waste ink absorbers 101 and 103. In the present embodiment, since at first the ink droplet d collides to the waste ink absorber 101 and the successively collides to the waste ink absorber 103, the flying velocity of the ink mist is reduced more properly. Here the V-shaped space may take either symmetrical or non-symmetrical. As in the fourth embodiment, since the material with rough density is used as the waste ink absorber 101 and 103, quantity of the generating ink mist during collision is reduced. Therefore it is possible to arrange the waste ink absorbers easily at a narrow space and to realize saving the space for the arrangement.

Embodiment 6

In the present embodiment a cavity 117 for receiving the ink droplet d is arranged in the pre-ejected ink receiving member 35 where the inner member 116 which forms cavity 37 is formed out of the waste ink absorber with rough density. When the material with rough density is used for the inner member 116 which forms the cavity 37 to which the ink droplet and ink mist collide, amount of the mist generated by the collision is reduced and the flying velocity of the generated ink mist is also reduced. The shielding member 34*a* is arranged under the pre-eject opening 37 of the platen 34 so as to prevent the ink mist flowing into below the platen 34.

Embodiment 7

Since the ink mist generated from ejected the ink droplet d flows along the colliding surfaces, in the present embodiment a narrow-necked pot structure is proposed for the pre-ejected ink receiving member 35, which prevent the ink mist from flowing out of a gap Sp1 formed between the shielding member 34*a* extending downward under the pre-eject opening 37 and the pre-ejected ink receiving member 35 formed out of the waste ink absorbing material according to the present invention. In other words, a cover 35*a* having an opening in its center is arranged at the opening of the pre-ejected ink receiving member 35. Further when the lower end of the shielding member 34*a* is narrowed a little bit, it is more effective for preventing the ink mist from blowing out.

Embodiment 8

Figure 11:
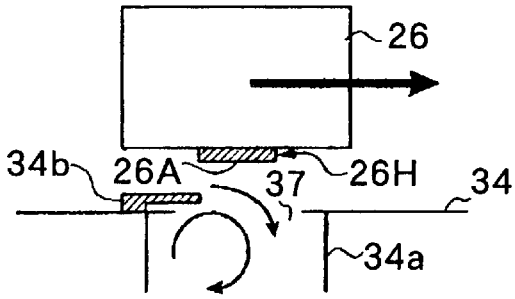
FIG. 11 is a schematic view illustrating other example of a structure of the platen according to the present invention.

In the present embodiment as shown in FIG. 11, a thin plate 34*b* made of, for example Mylar sheet (a trade name of Du-Pont) is formed in an opposite the direction along which the carriage 22 (see FIG. 13) mounting the ink cartridge 26 moves, on a position higher than the pre-eject opening 37 and not interfering with the ink head 26H so that the turbulent flow is generated for preventing the ink mist which generated immediately after the ejection and the floating ink mist after ejected into the pre-eject opening 37, from blowing out. Namely, the ink mist is prevented from blowing out by forming the thin plate 34*b* at the upper stream of the pre-eject opening 37 for generating the turbulent flows inside of the pre-eject opening 37 by the movement of the carriage. Consequently, since the mist is prevented from blowing out from gaps between parts of the recording apparatus, contamination in the recording apparatus is remarkably reduced. In the present embodiment the Mylar sheet 34*b* is also arranged under the pre-eject opening 37 of the platen 34 so as to prevent the ink mist m flowing into below the platen 34. In this embodiment the waste ink absorber according to the present invention is also employed in the pre-ejected ink receiving device member.

Embodiment 9

Figure 12:
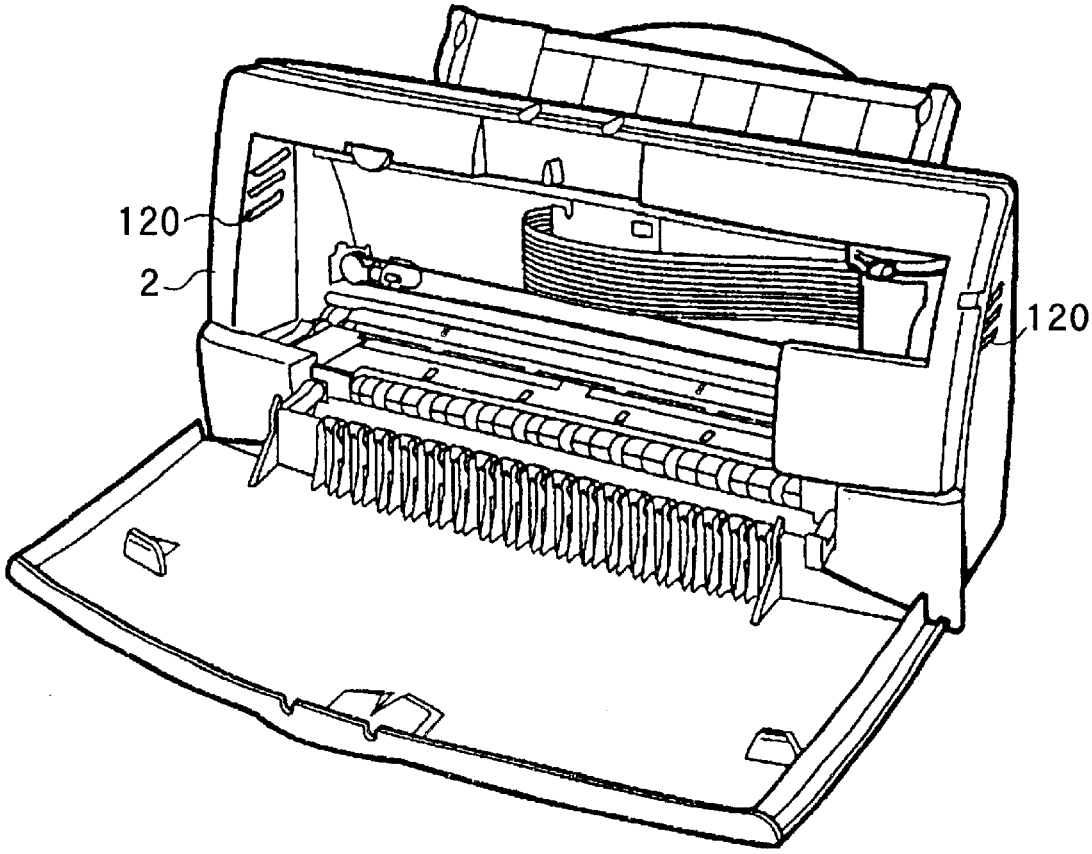
FIG. 12 is a perspective view illustrating an example of the structure of the ink-jet recording apparatus according to the present invention.

Since the ink mist once held in the pre-eject opening 37 is blown out by a wind pressure due to an increased air flow around the recording head and the pre-eject opening caused by a reduced pressure in a space formed between the carriage and the side face of the chassis when the carriage moves particularly reverses its moving direction, air bents 120 are formed as shown in FIG. 12 at the side of the carriage and at the position where the carriage reverses its moving direction so as to reduce the space where the pressure is reduced for decreasing the generated wind pressure, thus the ink mist is prevented properly from blowing up outward from the pre-eject opening 37. In this embodiment the waste ink absorber according to the present invention is also employed in the pre-ejected ink receiving device member.

Embodiment 10

The experiments by the inventors executed in the recording head with an eject rate 5 pl by reducing the driving frequency from 15 kHz confirmed that the smaller the driving frequency is the less the mist generated by collided ink droplets to the waste ink absorber. However, the good results where the ink mist is almost diminished are obtained when the low density waste ink absorber formed of a melamine resin at the driving frequency less than 5 kHz. Therefore when the driving frequency for the pre-eject is set lower than that for the printing operation in accordance with a surface density of the waste ink absorber, generating the ink mist during pre-eject is suppressed.

Embodiment 11

The experiments by the inventors confirmed that when the ejecting velocity is reduced the generated ink mist is reduced. More specifically, when the ejecting velocity is set less than, for example, 15 meters/sec., the generated ink mist is reduced. In the ink-jet print head where the ink is ejected by bubbles generated by heating elements and the ink-jet head having piezo electric elements, the ink mist generated when the ink droplet collides to the waste ink absorber, is reduced by controlling the voltage and the pulse for driving the recording head so as to reduce eject velocity during the pre-ejection.

Embodiment 12

Also the experiments confirmed that when the ink is ejected at 15 meters/sec. with respective ejecting rates 5 pl and 30 pl, when it collides to the waste ink absorber the generated ink mist with the ejecting rate 30 pl is less than that of the rate 5 pl. Therefore the voltage and the pulse for driving recording heads are controlled so as to increase the ejecting rate for reducing the generated mist.

As explained above, the ink mist is prevented from generating blowing out from the pre-eject opening by controlling the stream of the ink mist during pre-ejection by the present invention.

The present invention is applied to various types inkjet recording apparatuses where ink is used as the recording agent. However, the most excellent performance is realized in the recording head and the recording apparatus where energy generating means (such as electro-thermal conversion module, laser light etc.) for generating energy so as to change phase of the ink. Thus, excellent printing results with high density, with finer and with more precise quality are obtained.

It is preferable to apply the basic principle disclosed, for example, in the U.S. Pat. Nos. 4,723,129 and 4,740,796 to the present invention. Although the principle is applicable either to "on demand type" or to "continuous type", particularly it is more effective to the on-demand type, since the thermal energy is generated to cause a nuclear boiling on the surface of the thermal energy generating means arranged against sheets or liquid paths of the liquid eject heads where the liquid is held, namely to cause a film boiling on surfaces of liquid eject heads, by applying at least one driving signal, according to information to be printed. Which, as a result, is effective, since bubbles are formed in the liquid in accordance with respective driving signals. The liquid is ejected via the eject ports and is form at least one droplet by a cycle of growing and shrinking movements of bubbles. Pulse driving signals are more favorable since more responsive liquid ejection is attained due to a quick and proper cycle of growing and shrinking movements of bubbles. Pulse driving signals disclosed in the U.S. Pat. Nos. 4,463,359 and 4,345,262 are suitable as the signals mentioned above. When the conditions disclosed in the U.S. Pat. No. 4,313,124 relating to temperature increasing rate on the surface of the energy generating means, are applied, more excellent printing quality is realized.

Except arrangements disclosed in the above-referred U.S. patents combining eject ports, liquid paths and electro-thermal energy conversion elements (the straight liquid flow path where electro-thermal conversion elements are arranged along liquid path or perpendicular liquid flow path where electro-thermal conversion elements are arranged at the opposite side of eject ports with respect to liquid path), arrangements disclosed in the U.S. Pat. Nos. 4,558,333 and 4,459,600 where energy generating members are arranged at curved areas of liquid paths may be employed in the present invention. In addition, the arrangement disclosed in the Japanese laid open patent No.59-123670 where common slits are shared among a plurality of electro-thermal conversion elements as eject ports and the arrangement disclosed in the Japanese laid open patent No.59-138461 where openings to absorb pressure wave from thermal energy are arranged against eject portions are also effectively employed in the present invention. In other words, the present invention realizes reliable and effective printings, regardless of any arrangements of recording heads.

The present invention may be effectively applied to a full line type recording heads having a length corresponding to maximum width of a printing medium on which an image forming apparatus prints images. The full line type recording eject heads are obtained by combining a plurality of recording heads to fulfill the required width or by a recording head formed in one piece.

A solid recording head fixed to the main body of the apparatus, a tipped recording head demoutably mounted on the main body where electrical connections to the apparatus and ink supply from the apparatus are attained or a cartridge where a recording head and a tank for storing ink are formed in one piece, is also effectively employed in the above-mentioned serial type printer.

As arrangements for recording apparatus according to the present invention any types of means for recovering ink ejection may be employed. More specifically, the capping means for the recording head, the blade as a cleaning means, pressure application means, auxiliary heating means used together with the electro-thermal conversion means or other heating elements, or a combination of them and auxiliary eject means used except printing etc. may be employed. When the ink still sticks to or remains the head surface even after the recovering treatments, it is effective to arrange the absorber in the cap and the absorber for keeping the blade clean prevents ink from dropping to undesirable portions.

Any type or number of the recording head, for example, except one head for mono color, a plurality of heads for a different recording colors and color densities is applicable to the present invention. In other words it is quite effectively applied to a printing apparatus having at least one of the following printing modes for selecting a plurality of colors and mixed colors for full color printing.

In the embodiment of the present invention mentioned above, ink which solidifies at or less than room temperature and softens or melts at room temperature, may be used. Or since usually in ink-jet printings ink temperature is controlled between 30° C. and 70° C. so as to keep ink viscosity suitable for stable ejection, ink which liquefied when signals are applied, may be also used. In addition, ink which is solid at room temperature but is liquid when heated may be used, since temperature rising in ink and as a result evaporation of the ink is suppressed by a phase change where generated thermal energy is used for the phase change from a solid state to a liquid state. Any ink with a property liquefied for ejecting only when thermal energy applied, such as ink liquefied by applied thermal energy in accordance with printing signals, ink that starts solidifying just when it is deposited on printing media may be used. The liquid bearing above-mentioned properties may be used in ways disclosed in the Japanese laid open patents No.54-56847 and No. 60-71260 where ink is stored in the solid or liquid form in concave pits or through holes of the porous sheet arranged so as to face against electro-thermal conversion elements. In the present invention the film boiling method is the most effective for the above-mentioned various types of inks.

The ink-jet recording apparatuses applicable to the present invention are an image outputting terminal for an information processing unit such as a computer and the like, but also a copying device combined a reading device, a facsimile equipped with transmitting/receiving functions etc.

Since the waste ink absorber according to the present invention where pre-ejected ink collides directly is formed out of the material with rough density, the ink droplet is absorbed well.

Since the pre-ejected ink receiving device according to the present invention has pre-ejected ink receiving member where the incident angle of ink droplet against the waste ink absorber to which the ink droplet directly collides, the ink droplet is absorbed well.

Since the ink-jet recording apparatus according to the present invention controls the ejected velocity of the ink during pre-ejection slower than the ejected velocity of the ink during printing, generating ink mist may be suppressed.

In addition in the ink-jet recording apparatus according to the present invention, since the driving frequency of the pre-ejection is set lower than the driving frequency of printing operation, generating ink mist during the pre-ejection is suppressed.

And in the ink-jet recording apparatus according to the present invention, since the ejected ink volume during the pre-ejection is set more than the ejected ink volume during printing operation, the ink mist generated during the pre-ejection is properly suppressed.

What is claimed is:

1. A pre-ejected ink receiving device for receiving pre-ejected ink from an ink-jet recording head, comprising:

a waste ink absorber with which an ink droplet pre-ejected from said ink-jet recording head is collided, wherein an incident angle of ink droplet against said waste ink absorber is acute; and an exhaust opening for flowing out ink mist generated when the ink droplet is collided with said waste ink absorber.

2. The pre-ejected receiving device according to claim 1, wherein said incident angle is set between 20 and 50 degrees.

3. The pre-ejected ink receiving device according to claim 2, wherein said incident angle is set between 30 and 45 degrees.

4. The pre-ejected ink receiving device according to claim 1, wherein said exhaust opening has a plurality of turn-around portions in a mist flowing direction.

5. The pre-ejected ink receiving device according to claim 1, wherein said waste ink absorber is formed out of a material with rough density.

6. The pre-ejected ink receiving device according to claim 5, wherein said waste ink absorber is formed out of a foamed material having foam cells less than 300 per inch.

7. The pre-ejected ink receiving device according to claim 6, wherein said waste ink absorber has foam cells more than 20 per inch.

8. The pre-ejected ink receiving device according to claim 6, wherein said foamed material is a foamed melamine resin.

9. The pre-ejected ink receiving device according to claim 5, wherein said waste ink absorber has foam cells more than 20 per inch and less than 100 per inch.

10. An ink-jet recording apparatus for recording by ejecting ink from an ink-jet recording head, comprising:

a recording head mounting unit for mounting said ink-jet recording head;

a waste ink absorber with which an ink droplet pre-ejected from said ink-jet recording head is collided, wherein an incident angle of the ink droplet against said waste ink absorber is acute; and an exhaust opening for flowing out ink mist generated when the ink droplet is collided with said waste ink absorber.

11. The ink-jet recording apparatus according to claim 10, wherein said exhaust opening has a plurality of turn-around portions in a mist flowing direction.

12. The ink-jet recording apparatus according to claim 10, wherein said waste ink absorber is formed out of a material with rough density.

13. The ink-jet recording apparatus according to claim 12, wherein said waste ink absorber is formed out of a foamed material having foam cells less than 300 per inch.

14. The ink-jet recording apparatus according to claim 13, wherein said waste ink absorber has foam cells more than 20 per inch.

15. The ink-jet recording apparatus according to claim 13, wherein said foamed material is a foamed melamine resin.

16. The ink-jet recording apparatus according to claim 12, wherein said waste ink absorber has foam cells more than 20 per inch and less than 100 per inch.

* * * * *

UNITED STATES PATENT AND TRADEMARK OFFICE

CERTIFICATE OF CORRECTION

PATENT NO. : 6,565,189 B2
DATED : May 20, 2003
INVENTOR(S) : Yamada et al.

Figure 16:
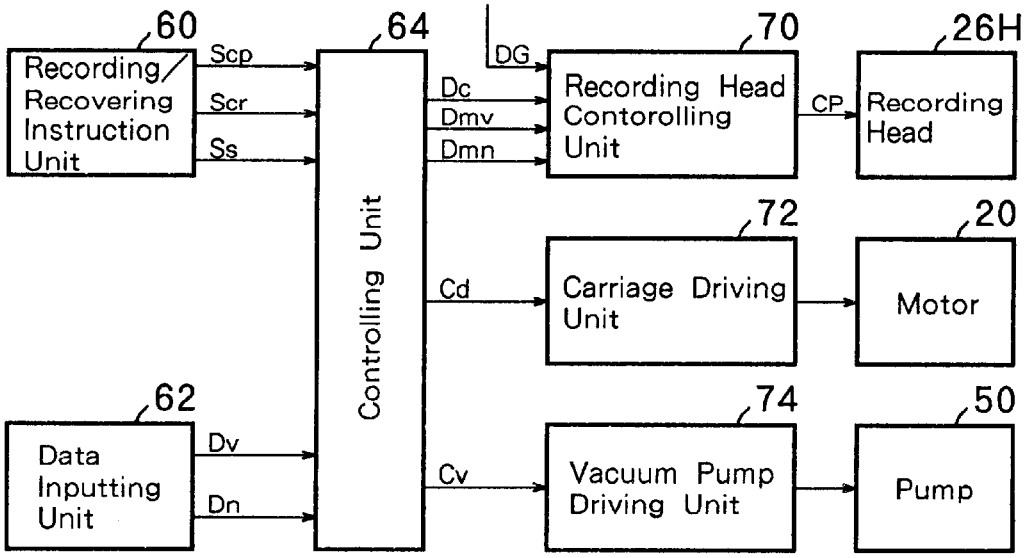
FIG. 16 is a block diagram showing controlling blocks arranged in the recording apparatus where ink recovery treatment is applied.

It is certified that error appears in the above-identified patent and that said Letters Patent is hereby corrected as shown below:

Drawings,
Sheet 9, FIG. 16, in the box corresponding to reference numeral 70, "Contorolling" should read -- Controlling --.

Column 1,
Line 12, "preject" should read -- pre-eject --;
Line 37, "method" should read -- methods --; and
Line 47, "type writers," should read -- typewriters, --.

Column 3,
Lines 19 and 22, "instant" should read -- instance --; and
Line 47, "an examples" should read -- examples --.

Column 4,
Line 6, "referring" should read -- referring to the --;
Line 9, "where" should read -- with --;
Line 22, "demoutably" should read -- demountably --;
Line 32, "incline" should read -- inclined --; and
Line 54, "end" should read -- ends --.

Column 5,
Line 12, "located" should read -- located on the --;
Line 17, "around" should read -- around by --;
Line 28, "a." should read -- a --; and
Line 33, "desired-color" should read -- desired color --.

Column 6,
Line 20, "held" should read -- held by --;
Line 23, "comprises;" should read -- comprising; --; and
Line 57, "etc.." should read -- etc. --.

Column 7,
Line 61, "300/inch" should read -- 300/inch. --; and
Line 65, "more" should read -- more than --.

Column 8,
Line 59, "the" (second occurrence) should be deleted.

Column 9,
Line 56, "the" (first occurrence) should be deleted.

UNITED STATES PATENT AND TRADEMARK OFFICE

CERTIFICATE OF CORRECTION

PATENT NO. : 6,565,189 B2
DATED : May 20, 2003
INVENTOR(S) : Yamada et al.

It is certified that error appears in the above-identified patent and that said Letters Patent is hereby corrected as shown below:

Column 10,
Line 12, “ejected the” should read -- the ejected --; and
Line 55, “bents” should read -- vents --.

Column 11,
Line 35, “types” should read -- types of -- and “inkjet” should read -- ink-jet --;
Line 47, “on demand” should read -- on-demand --;
Line 54, “to information” should read -- to the information --; and
Line 57, “is form” should be deleted and “droplet” should read -- droplet is formed --.

Column 12,
Line 29, “demoutably” should read -- demountably --;
Line 43, “remains” should read -- remains on --; and
Line 48, “a” (second occurrence) should be deleted.

Signed and Sealed this

Twentieth Day of January, 2004

JON W. DUDAS
*Acting Director of the United States Patent and Trademark Office*